US005804341A

United States Patent [19]

Bohan et al.

[11] Patent Number: 5,804,341

[45] Date of Patent: Sep. 8, 1998

[54] PROTECTIVE OVERCOATS FOR SILVER HALIDE PHOTOGRAPHIC ELEMENTS

[75] Inventors: Anne E. Bohan, Pittsford; Vito A. DePalma; William K. Goebel, both of Rochester; Dennis R. Kamp, Churchville, all of N.Y.

[73] Assignee: Eastman Kodak Company, Rochester, N.Y.

[21] Appl. No.: 698,838

[22] Filed: Aug. 16, 1996

[51] Int. Cl.[6] ..... G03C 3/00

[52] U.S. Cl. ..... 430/12; 430/47; 430/99; 430/124; 430/533; 430/961

[58] Field of Search ..... 430/12, 18, 939, 430/97, 965, 99, 523, 271.1, 533, 35, 104, 114, 124, 47; 399/342

[56] References Cited

U.S. PATENT DOCUMENTS

| | | | |
|---|---|---|---|
| 3,697,277 | 10/1972 | Kiog | 96/50 |
| 3,931,431 | 1/1976 | Giorgi | 428/201 |
| 4,333,998 | 6/1982 | Leszyk | 430/12 |
| 5,260,753 | 11/1993 | Haneda et al. | 355/282 |
| 5,339,146 | 8/1994 | Aslam et al. | 355/285 |
| 5,506,671 | 4/1996 | Buts et al. | 355/326 |

*Primary Examiner*—Thorl Chea

[57] ABSTRACT

A clear protective overcoat is provided to an image formed in a silver halide photographic element. The overcoat is formed by electrostatically applying a uniform distribution of clear toner to an imaged photographic element and then fusing the toner to form an overcoat. The toner can be applied only in a limited area of the element.

14 Claims, No Drawings

PROTECTIVE OVERCOATS FOR SILVER HALIDE PHOTOGRAPHIC ELEMENTS

FIELD OF THE INVENTION

This invention relates to a process for applying a protective overcoat to an image derived from a silver halide photographic element and to imaged elements protected by such an overcoat.

BACKGROUND OF THE INVENTION

Silver halide photographic elements contain light sensitive silver halide in a hydrophilic emulsion. An image is formed in the element by exposing the silver halide to light, or to other actinic radiation, and developing the exposed silver halide to reduce it to elemental silver.

In color photographic elements a dye image is formed as a consequence of silver halide development by one of several different processes. The most common is to allow a by-product of silver halide development, oxidized silver halide developing agent, to react with a dye forming compound called a coupler. The silver and unreacted silver halide are then removed from the photographic element, leaving a dye image.

In either case, formation of the image commonly involves liquid processing with aqueous solutions that must penetrate the surface of the element to come into contact with silver halide and coupler. Thus, gelatin, and similar natural or synthetic hydrophilic polymers, have proven to be the binders of choice for silver halide photographic elements. Unfortunately, when gelatin, and similar polymers, are formulated so as to facilitate contact between the silver halide crystal and aqueous processing solutions, they are not as tough and mar-resistant as would be desired for something that is handled in the way that an imaged photographic element may be handled. Thus, the imaged element can be easily marked by fingerprints, it can be scratched or torn and it can swell or otherwise deform when it is contacted with liquids.

Various techniques have been suggested to protect photographic elements from physical damage. One is to apply to the surface of the developed photographic element a preformed layer of a polymer more physically robust than gelatin, for example by lamination. Such a technique is described, for example, in U.S. Pat. No. 3,697,277. Another is to apply to the surface of the developed element a liquid composition which is cured to leave a tough polymer layer. Such a technique is described, for example, in U.S. Pat. No. 3,931.431. Unfortunately, these techniques for protecting the surface of a photographic element suffer from one or more problems. Lamination has several disadvantages. For example, lamination involves an added expense associated with coating an additional support. Also, it is susceptible to trapping pockets of air between the laminate and the element during the laminating step leading to image defects. Moreover, because the laminate is self-supporting before lamination, it is thicker than necessary, which is wasteful of materials and can cause the element to curl if it is applied to only one side of the element. Application of a liquid overcoat can avoid some of the problem associated with lamination, such as formation of air pockets. But it introduces other problems. For example, handling the liquid compositions can be messy and such compositions often contain environmentally undesirable solvents. Moreover, liquid coatings can be difficult to dry or can require a separate UV curing step.

Thus, it would be desirable to apply a protective overcoat to imaged photographic elements by a simple dry technique that gives easily applied, relatively thin overcoat layers.

Electrophotography entails forming an electrostatic charge pattern on a surface and then forming a pattern of a marking composition, called a toner, on that surface as a function of the location of the charge pattern. The resulting pattern of toner is made permanent on an image bearing surface by application of heat and/or pressure to cause the toner to fuse and adhere to the image bearing surface.

It has been suggested from time to time to overcoat such toner patterns in various ways. Use of clear toner to form a protective overcoat on a toner image has been suggested, for example, in U.S. Pat. Nos. 5,260,753, 5,339,146 and 5,506,671. However, there has been no suggestion in the art to use electrostatic or electrophotographic technology to apply a protective overcoat to images derived from silver halide photographic elements.

SUMMARY OF THE INVENTION

We have found that electrophotographic toner compositions can adhere to the hydrophilic surface of a photographic element and protect the surface of the image during normal handling.

Thus, in one embodiment, this invention provides a process for applying a protective overcoat to a photographic element comprising the steps of:

a) providing an imaged photographic element comprising a silver halide derived image in a hydrophilic binder;

b) applying to a major surface of the element, in the presence of an electric field, charged, clear polymeric particles so as to cause the particles to adhere to the surface of the element; and c) fusing the clear polymeric particles so as to cause them to form a continuous polymeric layer on the surface of element.

In another embodiment, the present invention provides an imaged photographic element having a thin protective overcoat of a clear electrophotographic toner polymer.

The present invention provides a simple, effective way to provide a relatively thin protective overcoat on a photographic element.

DETAILED DESCRIPTION OF THE INVENTION

A unique aspect of this invention is that it combines two technologies, silver halide imaging and electrophotography, each of which have been well developed independently. Each of these technologies has a well established literature, including patent literature, which can be referred to for details of materials and processes. In the case of silver halide technology, reference can be made to *Research Disclosure*, February 1995, Item 37038, pages 78–114, and the patents and publications referred to therein, the disclosures of which are incorporated herein by reference; hereinafter referred to as Research Disclosure 37038. Research Disclosure is published by Kenneth Mason Publications, Ltd., Dudley Annex, 12a North Street, Emsworth, Hampshire P010 7DQ, ENGLAND. In the case of electrophotographic technology, reference can be made to Schaffert, Electrophotography, 2d Ed., 1975, Focal Press Ltd. London, the disclosure of which is incorporated herein by reference.

The imaged photographic elements protected in accordance with this invention are derived from silver halide photographic elements that can be black and white elements (for example, those which yield a silver image or those which yield a neutral tone image from a mixture of dye forming couplers), single color elements or multicolor elements. Multicolor elements typically contain dye image-forming units sensitive to each of the three primary regions of the spectrum. The imaged elements can be imaged elements which are viewed by transmission, such a negative film images, reversal film images and motion picture prints or they can be imaged elements that are viewed by reflection, such a paper prints. Because of the amount of handling that can occur with paper prints and motion picture prints, they are preferred imaged photographic elements for use in this invention.

While a primary purpose of applying an overcoat to imaged photographic elements in accordance with this invention is to protect the element from physical damage, application of the overcoat may also protect the image from fading or yellowing. This is particularly true with elements which contain images that are susceptible to fading or yellowing due to the action of oxygen. For example, the fading of dyes derived from pyrazolone and pyrazoloazole couplers is believed to be caused, at least in part, by the presence of oxygen, so that the application of an overcoat which acts as a barrier to the passage of oxygen into the element will reduce such fading. Furthermore, if the toner does not have a neutral color, it can be used to modify or correct the hue of the image that had been formed in the element.

The photographic elements in which the images to be protected are formed can have the structures and components shown in Research Disclosure 37038. Specific photographic elements can be those shown on pages 96–98 of Research Disclosure 37038 as Color Paper Elements 1 and 2. A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent (for example, a film support) or reflective (for example, a paper support). Photographic elements protected in accordance with the present invention may also include a magnetic recording material as described in *Research Disclosure*, Item 34390, November 1992, or a transparent magnetic recording layer such as a layer containing magnetic particles on the underside of a transparent support as described in U.S. Pat. No. 4,279,945 and U.S. Pat. No. 4,302,523.

Suitable silver halide emulsions and their preparation, as well as methods of chemical and spectral sensitization, are described in Sections I through V of Research Disclosure 37038. Color materials and development modifiers are described in Sections V through XX of Research Disclosure 37038. Vehicles are described in Section II of Research Disclosure 37038, and various additives such as brighteners, antifoggants, stabilizers, light absorbing and scattering materials, hardeners, coating aids, plasticizers, lubricants and matting agents are described in Sections VI through X and XI through XIV of Research Disclosure 37038. Processing methods and agents are described in Sections XIX and XX of Research Disclosure 37038, and methods of exposure are described in Section XVI of Research Disclosure 37038.

Photographic elements typically provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like). Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like.

Photographic elements can be imagewise exposed using a variety of techniques. Typically exposure is to light in the visible region of the spectrum, and typically is of a live image through a lens. Exposure can also be to a stored image (such as a computer stored image) by means of light emitting devices (such as LEDs, CRTs, etc.).

Images can be developed in photographic elements in any of a number of well known photographic processes utilizing any of a number of well known processing compositions, described, for example, in T. H. James, editor, *The Theory of the Photographic Process,* 4th Edition, Macmillan, New York, 1977. In the case of processing a color negative element, the element is treated with a color developer (that is one which will form the colored image dyes with the color couplers), and then with an oxidizer and a solvent to remove silver and silver halide. In the case of processing a color reversal element, the element is first treated with a black and white developer (that is, a developer which does not form colored dyes with the coupler compounds) followed by a treatment to render developable unexposed silver halide (usually chemical or light fogging), followed by treatment with a color developer. Development is followed by bleach-fixing, to remove silver or silver halide, washing and drying.

Since the present invention does not use electrophotography to form an image, the term "electrostatic" can be used equally well to describe process steps and apparatus, instead of the term "electrophotographic", and those two terms will be used herein interchangeably. As indicated above, the present invention uses well known and widely available electrophotographic technology to apply toner to the surface of an imaged photographic element and to fuse the toner to that surface. Thus, the detailed discussion which follows is exemplary, and not limiting. Alternative ways of carrying out the steps of this process can be found in Schaffert, *Electrophotography,* 2d Ed., 1975, Focal Press Ltd. London, at the pages identified below:

| Step | Text | Patent Listing |
|---|---|---|
| Charging | pp. 30–32 | pp. 710–723 |
| Toning | pp. 35–42 | pp. 724–744 |
| Fusing | pp. 55–56 | pp. 784–791 |

The present invention applies to an imaged photographic element, obtained from a silver halide photographic element described above, process steps that are well known and routinely practiced in electrophotography. These steps are 1) the application of clear polymeric particles, also referred to herein as toner particles or as a toner, to the surface of the element and 2) the fusing of the clear polymeric particles to that surface.

The application of electrostatically charged toner particles to the surface of the element can be accomplished in a number of different ways. For example, the relatively insulating element can be placed in the electric field formed between a high voltage corona wire and a ground plate in order to accumulate surface charge on the element. Then, oppositely charged toner particles can be brought into contact with the charged surface, to which they adhere Another way of attracting toner particles to the surface of the element is by use of a magnetic brush toning apparatus in which a bias is formed between a charged roller, to which the toner and associated carrier particles are attracted and a counter electrode which, in the present case, is on the opposite side of the element from that to which the toner is to be applied. The fields are adjusted so that toner is repelled from the magnetic brush and is attracted towards the surface of the element.

Yet another way of adhering toner particles to the surface of the element is to attract them electrostatically from a magnetic brush toning apparatus to a relatively conductive intermediate transfer roller which is then biased to establish an electrostatic transfer field which repels the deposited toner particles from the intermediate roller to the surface of the element.

The toner particles may be charged, for example, by agitating the toner particles with a magnetic carrier, such as ferrite particles, in a mixing chamber. The charge level and polarity of the toner can be adjusted by the addition of a charge control agent to the toner or by a polymer coating on the magnetic carrier. This technique is well known in the electrophotographic art, as shown, for example, by U.S. Pat. No. 4,546,060, the disclosure of which is hereby incorporated by reference.

The toner is applied to the surface of the photographic element at a rate that will provide a continuous coating on the surface of the element of the desired thickness. A preferred thickness is in the range of between about 0.2 and 50 $\mu$m. An especially preferred thickness in the range of 1 to 10 $\mu$m. The lower limit of overcoat thickness is governed by the roughness of the surface to which the toner is applied; the rougher the surface the thicker the coating needed. The upper limit of overcoat thickness is governed by the field required to form the coating.

After the toner particles are applied to the surface of the element, the particles are heat fused and/or pressure fused to form an overcoat on the surface of the element. Fusing preferably is accomplished by contacting the surface of the element with a heated fusing member, such as a fusing belt or fusing roller. Thus, fusing can be accomplished by passing the element through a pair of heated rollers, heated to a temperature of, for example, 100° to 200° C., using a pressure of about 5 to about 15 MPa at a transport rate of about 0.005 to about 0.50 m/s.

Colorless toner particles are known for use in electrophotography and can be used in this invention. The particular toner selected for use should be compatible with the hydrophilic layers of photographic elements and should readily adhere to them. It is within the skill of the art to select suitable toners by routine screening. Because of the fragility of the photographic element to which the toner is to be applied, the toner polymer preferably has a glass transition temperature, Tg, in the range of 45° to 80° C., preferably 55° to 65° C.

Examples of polymers from which the toner particles used in this invention can be selected include poly(vinyl chloride), poly(vinylidene chloride), poly(vinyl chloride-co-vinylidene chloride), chlorinated polypropylene, poly(vinyl chloride-co-vinyl acetate), polylvinyl chloride-co-vinyl acetate-co-maleic anhydride), ethyl cellulose, nitrocellulose, poly(acrylic acid) esters, linseed oil-modified alkyd resins, rosin-modified alkyd resins, phenol-modified alkyd resins, phenolic resins, polyesters, poly(vinyl butyral), polyisocyanate resins, polyurethanes, poly(vinyl acetate), polyamides, chroman resins, dammar gum, ketone resins, maleic acid resins, vinyl polymers, such as polystyrene and polyvinyltoluene or copolymer of vinyl polymers with methacrylates or acrylates, poly(tetrafluoroethylene-hexafluoropropylene), low-molecular weight polyethylene, phenol-modified pentaerythritol esters, poly(styrene-co-indene-co-acrylonitrile), poly(styrene-co-indene), poly(styrene-co-acrylonitrile), poly(styrene-co-butadiene), poly(stearyl methacrylate) blended with poly(methyl methacrylate), copolymers with siloxanes and polyalkenes. These polymers can be used either alone or in combination. In a preferred embodiment of the invention, the toner comprises a polyester or poly (styrene-co-butyl acrylate). Preferred polyesters are based on ethoxylated and/or propoxylated bisphenol A and one or more of terephthalic acid, dodecenylsuccinic acid and fumaric acid.

To increase the abrasion resistance of the overcoat, polymers which are crosslinked or branched can be used. For example, poly(styrene-co-indene-co-divinylbenxene), poly (styrene-co-acrylonitrile-co-divinylbenzene), or poly (styrene-co-butadiene-co-divinylbenzene) can be used.

The toners should be clear, i.e., transparent, and are preferably colorless. But it is specifically contemplated that the toner can have some color for the purposes of color correction, or for special effects, so long as the image is viewable through the overcoat. Thus, there can be incorporated into the toner dye which will impart color. In addition, additives can be incorporated into the toner which will give to the overcoat desired properties. For example, a UV absorber can be incorporated into the toner to make the overcoat UV absorptive, thus protecting the image from UV induced fading.

In addition to the toner particles which form the overcoat there can be combined with the toner composition, transferred to the surface of the element and incorporated in the overcoat, other particles which will modify the surface characteristics of the element. Such particle are solid and nonfusible at the conditions under which the toner particles are fused, and include inorganic particles, like silica, and organic particles, like methylmethacrylate beads, which will not melt during the fusing step and which will impart surface roughness to the overcoat. When incorporated in the toner composition, such particles can comprise up to about 80% percent by weight based on the weight of the toner.

The surface characteristics of the overcoat are in large part dependent upon the physical characteristics of the polymer which forms the toner and the presence or absence of solid, nonfusible particles. However, the surface characteristics of the overcoat also can be modified by the conditions under which the surface is fused. For example, the surface characteristics of the fusing member that is used to fuse the toner to form the continuous overcoat layer can be selected to impart a desired degree of smoothness, texture or pattern to the surface of the element. Thus, a highly smooth fusing member will give a glossy surface to the imaged element, a textured fusing member will give a matte or otherwise textured surface to the element, a patterned fusing member will apply a pattern to the surface of the element, etc.

While the expected way in which the process of this invention will be used is to cover an entire surface of the imaged element with an overcoat layer, it is specifically contemplated that toner can be applied only in discrete regions of the surface to give special effects, such as to provide an area for writing on the face of the element.

The following example further illustrates this invention.

EXAMPLE 1

Samples of silver halide color photographic elements sold under the KODACOLOR®, ROYAL®, EDGE®, PORTRA® and DURAFLEX® trademarks were exposed in an imagewise fashion and then processed through the commercially available Kodak RA4® development process to obtain imaged photographic prints. The imaged photographic prints were then electrostatically toned with a clear polymeric toner by placing in a toner holder 800 g of developer comprising 10% polyester toner and 90% iron/strontium (6:1) ceramic magnetic carrier particles. The toner comprised a polyester sold under the tradename KAO M® available from KAO Inc. Racine, Wis. The toner had an average particle size of 10 $\mu$m and the carrier had a nominal particle size of 30–50 $\mu$m. The carrier transported the toner by means of rotating magnets in a shell to an offset roller. The photographic prints were fed between an offset roller and a backing roller with the emulsion side toward the offset roller at a speed of 8 cm/s. A bias voltage of 2500 volts was applied to the backing roller to transfer approximately 8 to 11 g of toner particles per $m^2$ of photographic material. No carrier was detected on the final print.

Fusing was accomplished by running the toned sample through a belt fuser. The toner image runs through a nip heated to 155° C. under a pressure of 1.2 MPa from a 2.6 cm pressure roller at 4 cm/s. The toned portion of each element was in contact with a stainless steel belt as it passed through the nip and remained in contact with the belt for an additional 50 cm while the toner cooled. Allowing the element to cool while in contact with the belt reduced offset (toner adhering to the belt rather than the toned sample) and gave a high gloss surface. The resulting overcoated elements had an overcoat thickness of 9 $\mu$m.

The resulting images had a higher gloss surface than the original image that had not been overcoated. The overcoated images had an average gloss of 92 gloss units (20 degrees) compared with an average gloss of 73 gloss units (20 degrees) for the non-overcoated images. Gloss was measured using known Gardner® gloss measuring apparatus. When water droplets were applied to the surface of the overcoated prints, they beaded up and were easily wiped off without deforming the surface of the print. When water droplets were applied to the surface of a non-overcoated print, the droplets spread, swelling the gelatin and deforming the surface of the print. After the gelatin is swollen, the print is easily scratched if the water is wiped away.

Similar results were obtained when the process of this example was repeated with a toner comprising a poly (styrene-co-butyl acrylate) copolymer which was again ground to an average size of 10 $\mu$m that is sold under the tradename Picotoner 1221® by Hercules Inc.

The invention has been described in detail with particular reference to preferred embodiments thereof, but it will be understood that variations and modifications can be effected within the spirit and scope of the invention.

What is claimed is:

1. A process for applying a protective overcoat to an imaged photographic element, the process comprising the steps of:

a) providing an imaged photographic element comprising a silver halide derived image in a hydrophilic binder;

b) applying to a major surface of the element, in the presence of an electric field, charged, clear polymeric particles so as to cause the particles to adhere to the surface of the element; and c) fusing the clear polymeric particles so as to cause them to form a continuous polymeric layer on the surface of element.

2. A process of claim 1 wherein the imaged photographic element is a photographic image on a reflective support.

3. A process of claim 1 wherein the imaged photographic element is a photographic image on a transparent support.

4. A process of claim 1 wherein the polymeric particles are comprised of a polyester comprising ethoxylated and/or propoxylated bisphenol A and one or more of terephthalic acid, dodecenylsuccinic acid and fumaric acid.

5. A process of claim 1 wherein the polymeric particles are comprised of a poly(styrene-co-butyl acrylate) copolymer.

6. A process of claim 1 wherein the polymeric particles are applied at a coverage which provides an overcoat thickness in the range of 0.2 to 50 $\mu$m.

7. A process of claim 1 wherein associated with the polymeric particles are solid, non-fusible inorganic or organic particles.

8. A process of claim 1 wherein the polymeric particles are fused by application of heat.

9. A process of claim 1 wherein the polymeric particles are fused by application of heat and pressure.

10. An imaged photographic element having a thin protective overcoat of a clear electrophotographic toner polymer wherein the overcoat is comprised of a polymer selected from the group consisting of a) a polyester comprising ethoxylated and/or propoxylated bisphenol A and one or more of terephthalic acid, dodecenyl succinic acid and fumaric acid, and b) a polystyrene-co-butyl acrylate copolymer.

11. An imaged photographic element of claim 10, wherein the overcoat has a thickness in the range of between 0.2 and 50 $\mu$m.

12. An imaged photographic element of claim 10, wherein the overcoat comprises solid, non-fusible inorganic or organic particles.

13. An imaged photographic element of claim 10, wherein the overcoat has a glossy surface.

14. An imaged photographic element of claim 10, wherein the overcoat has a textured or patterned surface.

* * * * *